US007029082B2

(12) United States Patent
Farr et al.

(10) Patent No.: US 7,029,082 B2
(45) Date of Patent: Apr. 18, 2006

(54) PRINTING DEVICE HAVING A PRINTING FLUID DETECTOR

(75) Inventors: Isaac Farr, Corvallis, OR (US); Shane Shivji, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 166 days.

(21) Appl. No.: 10/613,797

(22) Filed: Jul. 2, 2003

(65) Prior Publication Data

US 2005/0001863 A1 Jan. 6, 2005

(51) Int. Cl.
*B41J 2/195* (2006.01)
*B41J 2/19* (2006.01)

(52) U.S. Cl. ..... 347/7; 347/92

(58) Field of Classification Search ..... 347/7, 347/92, 84, 85, 86, 9, 19, 95
See application file for complete search history.

(56) References Cited

U.S. PATENT DOCUMENTS 3,805,276 A 4/1974 Ishii
3,950,761 A 4/1976 Kashio
4,319,484 A 3/1982 Keller
4,432,005 A 2/1984 Duffield et al.
4,558,326 A 12/1985 Kimura et al.
4,568,954 A 2/1986 Rosback
4,800,755 A 1/1989 Fathauer et al.
4,841,256 A 6/1989 Gastgeb
4,956,763 A 9/1990 Stewart, Jr. et al.
5,329,304 A * 7/1994 Koizumi et al. ..... 347/7
5,367,328 A 11/1994 Erickson
5,506,611 A 4/1996 Ujita et al.
5,574,489 A 11/1996 Cowger et al.
5,583,544 A * 12/1996 Stamer et al. ..... 347/7
5,596,351 A * 1/1997 Stapleton ..... 346/140.1
5,611,240 A 3/1997 Yamaguchi
5,682,184 A * 10/1997 Stephany et al. ..... 347/7
5,689,288 A * 11/1997 Wimmer et al. ..... 347/7
5,699,091 A 12/1997 Bullock et al.
5,719,556 A 2/1998 Albin et al.
5,721,576 A 2/1998 Barinaga
5,771,053 A 6/1998 Merrill
5,777,646 A 7/1998 Barinaga et al.
5,844,576 A 12/1998 Wilde et al.
5,880,764 A 3/1999 Barinaga
6,084,605 A * 7/2000 Yaji ..... 347/19
6,246,831 B1 6/2001 Seitz et al.
6,322,182 B1 * 11/2001 Lin et al. ..... 347/7
6,402,277 B1 * 6/2002 Monclus et al. ..... 347/7
6,474,156 B1 * 11/2002 Endo et al. ..... 73/290 V (Continued)

FOREIGN PATENT DOCUMENTS

EP 0720916 A2 7/1996

*Primary Examiner*—Manish Shah
*Assistant Examiner*—Leonard Liang

(57) ABSTRACT

A printing device is provided, wherein the printing device includes a printing fluid reservoir configured to hold a volume of a printing fluid, a print head assembly configured to transfer the printing fluid to a printing medium, a conduit fluidically connecting the printing fluid reservoir and the print head assembly, and a printing fluid detector. The printing fluid detector includes first and second electrodes configured to be in contact with the printing fluid, and is configured to distinguish printing fluid from printing fluid froth by taking an impedance measurement across the first and second electrodes and comparing the impedance measurement to a froth threshold impedance value that is calibrated to a measured printing fluid temperature.

68 Claims, 3 Drawing Sheets

U.S. PATENT DOCUMENTS 6,685,290 B1 * 2/2004 Farr et al. ..... 347/7
6,874,861 B1 * 4/2005 Farr et al. ..... 347/19
6,929,343 B1 * 8/2005 Farr et al. ..... 347/19
2004/0218000 A1 * 11/2004 Farr et al. ..... 347/19
2004/0223021 A1 * 11/2004 Farr et al. ..... 347/19
2005/0024396 A1 * 2/2005 Farr ..... 347/7

* cited by examiner

PRINTING DEVICE HAVING A PRINTING FLUID DETECTOR

BACKGROUND

Many types of printing devices, including but not limited to printers, copiers, and facsimile machines, print by transferring a printing fluid onto a printing medium. These printing devices typically include a printing fluid supply or reservoir configured to store a volume of printing fluid. The printing fluid reservoir may be located remotely from the print head assembly ("off-axis"), in which case the fluid is transferred to the print head assembly through a suitable conduit, or may be integrated with the print head assembly ("on-axis"). Where the printing fluid reservoir is located off-axis, the print head assembly may include a small reservoir that is periodically refilled from the larger off-axis reservoir.

Some printing devices may include a printing fluid detector configured to produce an out-of-fluid signal when printing fluid in the print head assembly or printing fluid reservoir drops below a predetermined level. This signal may be used to trigger the printing device to stop printing, and also to alert a user to the out-of-fluid state. The user may then replace (or replenish) the printing fluid reservoir and resume printing.

Various types of printing fluid detectors are known. Examples include, but are not limited to, optical detectors, pressure-based detectors, resistance-based detectors and capacitance-based detectors. Capacitance-based printing fluid detectors may utilize a pair of capacitor plates positioned adjacent, but external, to the printing fluid. These detectors measure changes in the capacitance of the plates with changes in printing fluid levels. However, the changes in capacitance of these systems may be too small to easily distinguish the capacitance changes from background noise. Thus, it may be difficult to accurately determine a printing fluid level, resulting in the generation of false out-of-fluid signals, and/or the failure to generate out-of-fluid signals when appropriate. Furthermore, many capacitance- and resistance-based detectors may have difficulty distinguishing printing fluid from printing fluid froth, which is commonly found in a printing fluid reservoir after the reservoir is substantially emptied of printing fluid.

SUMMARY

A printing device is provided, wherein the printing device includes a printing fluid reservoir configured to hold a volume of a printing fluid, a print head assembly configured to transfer the printing fluid to a printing medium, a conduit fluidically connecting the printing fluid reservoir and the print head assembly, and a printing fluid detector. The printing fluid detector includes first and second electrodes configured to be in contact with the printing fluid, and is configured to distinguish printing fluid from printing fluid froth by taking an impedance measurement across the first and second electrodes and comparing the impedance measurement to a froth threshold impedance value that is calibrated to a measured printing fluid temperature.

DETAILED DESCRIPTION

Figure 1:
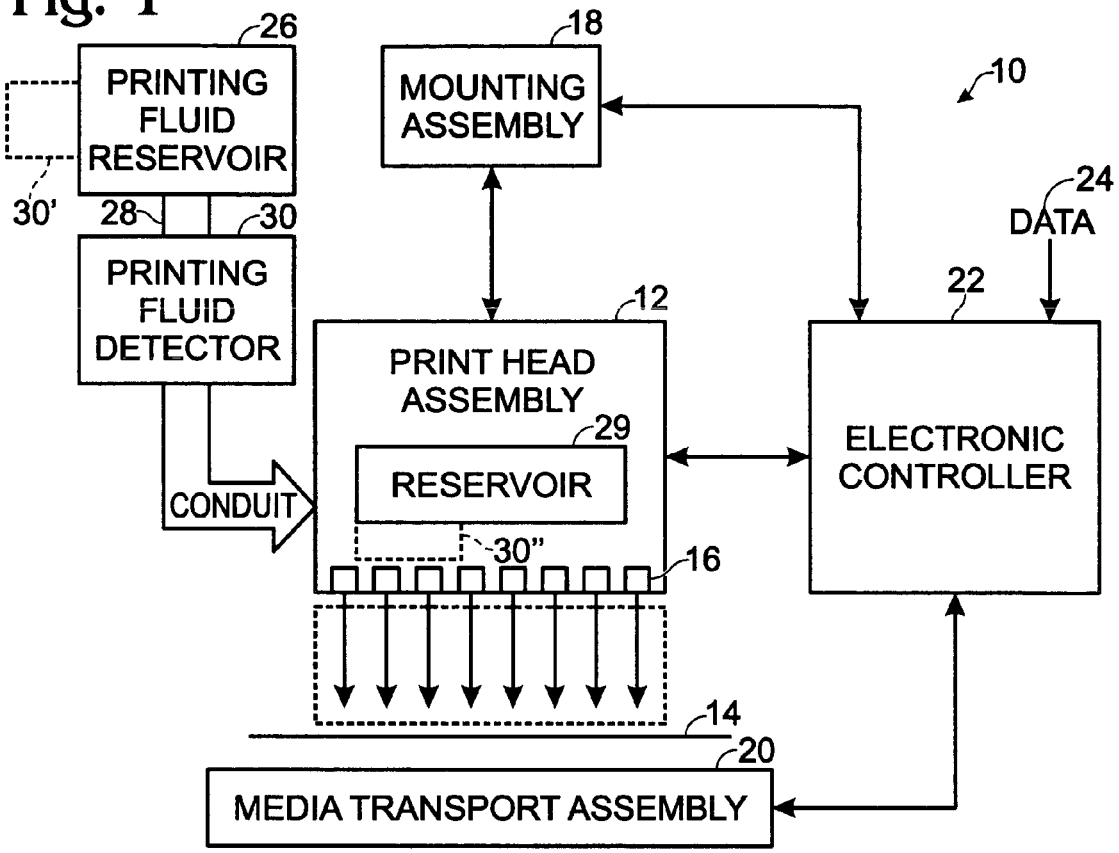
FIG. 1 is a block diagram of a printing device according to a first embodiment of the present invention.

FIG. 1 shows, generally at 10, a block diagram of a first embodiment of a printing device according to the present invention. Printing device 10 may be any suitable type of printing device, including but not limited to, a printer, facsimile machine, copier, or a hybrid device that combines the functionalities of more than one of these devices. Printing device 10 includes a print head assembly 12 configured to transfer a printing fluid onto a printing medium 14 positioned adjacent to the print head assembly. Print head assembly 12 typically is configured to transfer the printing fluid onto printing medium 14 via a plurality of fluid ejection mechanisms 16. Fluid ejection mechanisms 16 may be configured to eject printing fluid in any suitable manner. Examples include, but are not limited to, thermal and piezoelectric fluid ejection mechanisms.

Print head assembly 12 may be mounted to a mounting assembly 18 configured to move the print head assembly relative to printing medium 14. Likewise, printing medium 14 may be positioned on, or may otherwise interact with, a media transport assembly 20 configured to move the printing medium relative to print head assembly 12. Typically, mounting assembly 18 moves print head assembly 12 in a direction generally orthogonal to the direction in which media transport assembly 20 moves printing medium 14, thus enabling printing over a wide area of printing medium 14.

Printing device 10 also typically includes an electronic controller 22 configured to receive data 24 representing a print job, and to control the ejection of printing fluid from print head assembly 12, the motion of mounting assembly 18, and the motion of media transport assembly 20 to effect printing of an image represented by data 24.

Printing device 10 also includes a printing fluid supply or reservoir 26 configured to supply printing fluid stored within the printing fluid reservoir to print head assembly 12 as needed. Printing fluid reservoir 26 is fluidically connected to print head assembly 12 via a conduit 28 configured to transport printing fluid from the printing fluid reservoir to the print head assembly. Any of print head assembly 12, printing fluid reservoir 26, or conduit 28 may include a suitable pumping mechanism (not shown) for effecting the transfer of printing fluid from the printing fluid reservoir to the print head assembly. Examples of suitable pumping devices include, but are not limited to, peristaltic pumping devices.

Printing fluid reservoir 26 may be configured to deliver printing fluid to print head assembly 12 continuously during printing, or may be configured to deliver a predetermined volume of printing fluid to the print head assembly periodically. Where printing fluid reservoir 26 is configured to deliver a predetermined volume of printing fluid to print head assembly 12 periodically, the print head assembly may include a smaller reservoir 29 configured to hold printing fluid transferred from printing fluid reservoir 26.

Printing device 10 also includes a printing fluid detector 30. Printing fluid detector 30 is configured to measure an impedance value associated with the printing fluid, and to determine a characteristic of the printing fluid based upon the measured impedance value. For example, printing fluid detector 30 may be configured to distinguish between printing fluid, printing fluid froth and air to generate an out-of-fluid signal when froth or air is detected, or may be configured to determine a type of printing fluid currently in use in printing device 10.

Printing fluid detector 30 may be positioned in any of a number of locations on printing device 10. For example, printing fluid detector may be disposed along conduit 28 between printing fluid reservoir 26 and print head assembly 12. In this location, printing fluid detector 30 may be configured to determine a characteristic of the printing fluid within conduit 28. Alternatively, printing fluid detector 30 may be associated with printing fluid reservoir 26, as indicated at 30', or with smaller reservoir 29, as indicated at 30", to detect a presence, absence or type of printing fluids in these structures.

Figure 2:
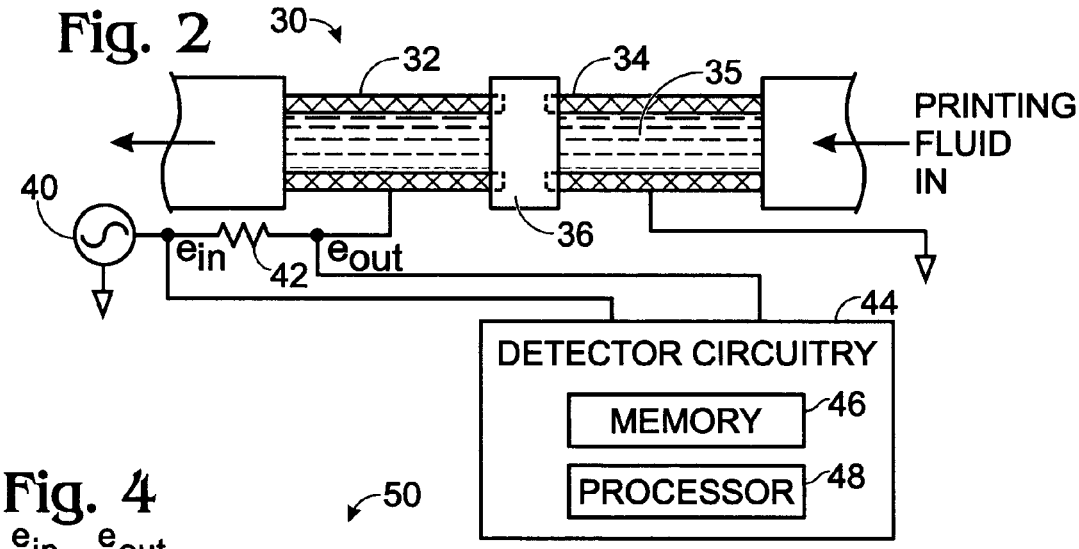
FIG. 2 is a schematic depiction of a first exemplary embodiment of the printing fluid detector of the printing device of FIG. 1.

FIG. 2 shows a schematic depiction of a first exemplary embodiment of printing fluid detector 30, which is configured to be disposed along conduit 28.

Printing fluid detector 30 includes a first electrode 32 and a second electrode 34.

Each electrode has a hollow interior through which printing fluid may flow, and solid walls configured to contain the printing fluid within the hollow interior. Thus, each electrode forms a portion of conduit 28.

First electrode 32 and second electrode 34 are each electrically conductive, and are separated from each other by an electrically insulating conduit segment 36. First electrode 32 and second electrode 34 are arranged in the conduit such that printing fluid 35 flowing from printing fluid reservoir 26 into print head assembly 12 first flows through one of the electrodes, then through electrically insulating conduit segment 36, and then through the other electrode before reaching the print head assembly. In FIG. 2, printing fluid is depicted as flowing first through second electrode 34. However, it will be appreciated that printing fluid may also flow first through first electrode 32.

Printing fluid detector 30 also includes power supply circuitry 40 configured to apply an alternating signal to the first electrode or second electrode (or, equivalently, across the first and second electrodes). A resistor 42 is disposed between power supply circuitry 40 and first electrode 32, in series with first electrode 32 and second electrode 34.

Additionally, printing fluid detector 30 includes detector circuitry 44 configured too determine a measured impedance value of the printing fluid from a comparison of the supply signal $e_{in}$ and a detected signal $e_{out}$. As shown in FIG. 2, $e_{in}$ may be measured at the power supply of resistor 42, and $e_{out}$ may be measured at the side of resistor 42 closer to first electrode 32. Alternatively, $e_{in}$ and $e_{out}$ may be measured at any other suitable location where the one signal is altered from the other by the impedance of the printing fluid. The measured impedance value, either a capacitance value or a resistance value, may then be used to determine a characteristic of printing fluid 35 in printing fluid reservoir 26, including but not limited to, a printing fluid type and an out-of-fluid condition. Futhermore, where the rate of transfer of printing fluid from printing fluid reservoir 26 to print head assembly 12 is known, a printing fluid level in printing fluid reservoir 26 may also be determined.

Detector circuitry 44 may include a memory 46 and a processor 48 for comparing the supply signal and the detected signal to determine the measured impedance value. For example, memory 46 may be configured to store instructions executable by processor 48 to perform the comparison of the supply signal and detected signal to determine the measured impedance value. The instructions may also be executable by processor 48 to compare the measured impedance value to a plurality of predetermined impedance values correlated to specific printing fluid characteristics and arranged in a look-up table also stored in memory 46 to determine the desired characteristic of the printing fluid in conduit 28.

Figure 3:
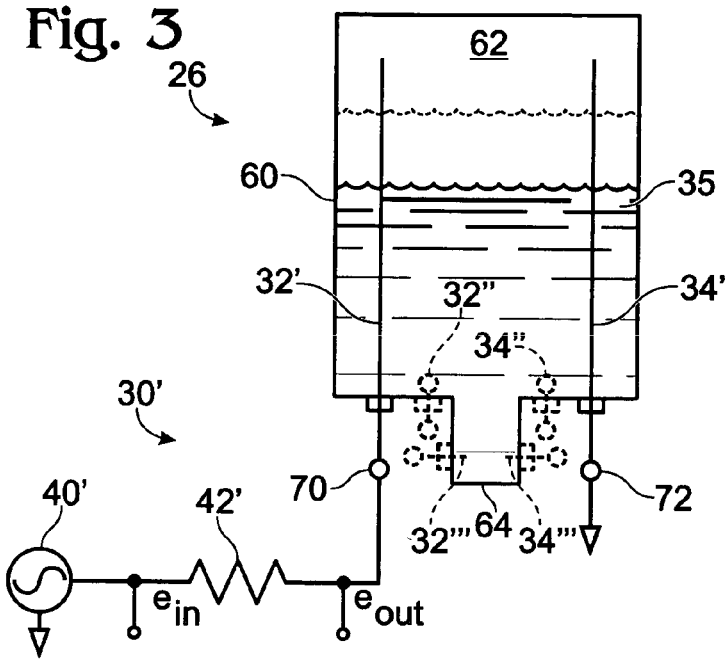
FIG. 3 is a schematic depiction of a second exemplary embodiment of the printing fluid detector of the printing device of FIG. 1, with the detector circuitry omitted.

FIG. 3 shows a schematic depiction of an exemplary embodiment of a printing fluid detector configured to be used as printing fluid detector 30' with printing fluid reservoir 26, or as printing fluid detector 30" with print head assembly reservoir 29. While FIG. 3 is described below in the context of printing fluid detector 30', it will be appreciated that the description is also applicable to printing fluid detector 30".

First, printing fluid reservoir 26 includes a body 60 defining an inner volume 62 configured to hold a volume of printing fluid 35, and an outlet 64 configured to pass printing fluid into conduit 28. Printing fluid reservoir 26 is depicted as being partially filled with printing fluid. However, it will be appreciated that printing fluid reservoir 26 typically begins a use cycle substantially completely filled with a printing fluid, and eventually transfers most or all of the printing fluid to print head assembly 12.

Next, printing fluid detector 30' includes a first electrode 32' and a second electrode 34' disposed within printing fluid reservoir inner volume 62 of printing fluid reservoir 26. Printing fluid detector 30' also includes power supply circuitry 40' configured to apply an alternating signal to first 32' and second electrode 34'. A resistor 42' is disposed between power supply circuitry 40' and first electrode 32', in series with first electrode 32', second electrode 34' and printing fluid 35. Printing fluid detector 30' may also include suitable detector circuitry (not shown) to measure an applied signal at $e_{in}$ and a detected signal at $e_{out}$. Suitable detector circuitry includes, but is not limited to, detector circuitry 44 described above in reference to FIG. 2.

First electrode 32' and second electrode 34' may each have any suitable shape and size. For example, first electrode 32' and second electrode 34' may each have a plate-like configuration similar to that of a traditional capacitor, or a mesh-like configuration. Alternatively, rather than having a plate-like configuration of traditional capacitor electrodes, first electrode 32' and second electrode 34' may have thin, needle-like or wire-like shapes. The terms "needle-like" and "wire-like" are used herein to denote an elongate configuration in which a long dimension of the electrode is substantially greater than two shorter directions orthogonal to the long dimension and to each other. The use of electrodes of these shapes is possible due to the large capacitances per unit surface area generated by the electrodes, as described in more detail below.

First electrode 32' and second electrode 34' may be coupled to body 60 in any suitable manner. In the depicted embodiment, first electrode 32' and second electrode 34' extend through body 60 of printing fluid reservoir 26 to a pair of external contacts, which are illustrated schematically in FIG. 3 as first contact 70 and second contact 72. Electrical contacts 70 and 72 may be configured to automatically form a connection with complementary contacts on printing device 10 (not shown) when printing fluid reservoir 26 is correctly mounted to printing device 10. This may enable printing fluid detector 30' to be easily connected to and disconnected from power supply 40', as well as any detector circuitry, during printing reservoir removal and/or replacement.

The electrodes may have other configurations and positions than those shown for electrodes 32' and 34'. For example, either of the electrodes, or each of the electrodes, may have a configuration that remains substantially covered by printing fluid until printing fluid reservoir 26 is substantially emptied of printing fluid. This is illustrated schematically via electrodes 32" and 34", which are shown in dashed lines as being disposed adjacent a bottom surface of printing fluid reservoir 26.

Additionally, either of, or both of, the first electrode and the second electrode may be disposed in outlet 64 of printing fluid reservoir 26, rather than within interior 62 of the printing fluid reservoir. This is illustrated schematically via electrodes 32''' and 34'''. In this configuration, essentially all of the printing fluid in printing fluid reservoir may be emptied before electrodes 32''' and 34''' are exposed. Thus, placing electrodes 32''' and 34''' in outlet 64 may allow more printing fluid to be emptied from printing fluid reservoir 26 before the generation of an out-of-fluid signal than placing the electrodes on the bottom surface of the printing fluid reservoir. While electrodes 32''' and 34''' are disposed in outlet 64 the same distance from the bottom of outlet 64, it will be appreciated that electrodes 32''' and 34''' may also be disposed in the outlet at different distances from the bottom of the outlet.

As described above, first electrodes 32, 32', 32", and 32''' and second electrodes 34, 34', 34", and 34''' are configured such that the electrically conductive materials that form the electrodes are in direct contact with printing fluid when printing fluid is present. By placing the first electrode and the second electrode in direct contact with the printing fluid, extremely large capacitances may be formed. When two electrodes are placed in an ionic fluid, such as many printing fluids, and charged with opposite polarities, a layer of negative ions forms on the positively charged electrode, and a layer of positive ions forms on the negatively charged electrode. Furthermore, additional layers of positive and negative ions form on the innermost ion layers, forming alternating layers of oppositely charged ions extending outwardly into the printing fluid from each electrode. This charge structure is referred to as an electrical double layer (EDL), due to the double charge layer represented by the charges in the electrode and the charges in the first ion layer on the electrode surface.

Figure 4:
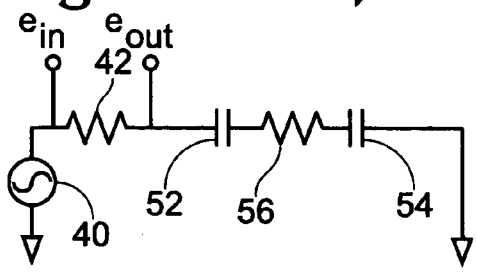
FIG. 4 is a schematic depiction of an equivalent circuit of the embodiments of FIGS. 2 and 3.

The EDL at each electrode acts effectively a capacitor, wherein the layer of ions acts as one plate and the electrode acts as the other plate. The effective circuit of the electrodes in the solution is shown generally at 50 in FIG. 4, wherein capacitor 52 represents the EDL at first electrode 32, and capacitor 54 represents the EDL at second electrode 44. The printing fluid will also have an associated resistance, represented by resistor 56.

Due to the atomic-scale proximity of the ions to the electrode in the EDL, and to the fact that capacitance varies inversely with the distance of charge separation in a capacitor, extremely large capacitances per unit electrode surface area are generated in the EDLs associated with electrodes 32 and 34. The capacitances may be orders of magnitude larger than those possible with electrodes not in contact with the printing fluid. For example, where the surface areas and separation of first electrode 32 and second electrode 34 would be expected to result in a capacitance in the femptofarad range, capacitances in the nanofarad or microfarad range are observed. These large capacitances facilitate the measurement of the impedance of the printing fluid in printing fluid reservoir 26, conduit 28, and/or print head reservoir 29.

Likewise, when printing fluid is drained from between the first and second electrodes, much lower capacitances are observed. For example, where printing fluid is sufficiently drained such that printing fluid contacts only one electrode, or neither electrode, the EDL capacitance may be significantly reduced. Thus, in this instance, the capacitance of the first and second electrodes is lower than when both electrodes are in contact with printing fluid. The drop in capacitance may be easily distinguishable from noise. Thus, this difference in capacitance may be used to detect an out-of-fluid condition within the conduit, and thus an out-of-fluid condition in printing fluid reservoir 26.

First electrode 32 and second electrode 34 may be made of any suitable electrically conductive material. Examples of suitable materials include, but are not limited to, metals such as stainless steel, platinum, gold and palladium. Alternatively, first electrode 32 and second electrode 34 may be made from an electrically conductive carbon material. Examples include, but are not limited to, activated carbon, carbon black, carbon fiber cloth, graphite, graphite powder, graphite cloth, glassy carbon, carbon aerogel, and cellulose-derived foamed carbon. To increase the conductivity of a carbon-based electrode, the carbon may be modified by oxidation. Examples of suitable techniques to oxidize the carbon include, but are not limited to, liquid-phase oxidations, gas-phase oxidations, plasma treatments, and heat treatments in inert environments.

In some embodiments, first electrode 32 and second electrode 34 may be coated with an electrically conductive coating. For example, first electrode 32 and second electrode 34 may be coated with a material having a high surface area-to-volume ratio to increase the effective surface area of the electrode. This may increase the capacitances that may be achieved with the electrode, as the electrode surface may accommodate more charge. The use of such a coating may allow smaller electrodes to be used without any sacrifice in measurement sensitivity. The use of a coating also may offer the further advantage of protecting the electrode material from corrosion by the printing fluid. Examples of suitable electrically conductive coatings include, but are not limited to, Teflon-based coatings (which may be modified with carbon), polypyrroles, polyanilines, polythiophenes, conjugated bithiazoles and bis-(thienyl)bithiazoles. Furthermore, the coating may be selectively crosslinked to reduce the level and type of adsorbed printing fluid components.

Power supply 40 (or 40') may be configured to provide an alternating signal to the first and second electrodes. The use of an alternating signal of a selected frequency may allow the influence of unwanted impedance components to be lessened relative to the impedance component being measured. As is well known in the electrical arts, a capacitor may cause a phase shift in an alternating signal, in that the current through the capacitor leads the voltage across the capacitor. This effect is observed with EDL capacitance. The magnitude of the phase shift is a function of both the frequency of the signal and the capacitance of the capacitor. Thus, the capacitance may be more easily measured by selecting a frequency at which the phase shift between the voltage across the electrodes and the current through the electrodes is significant. Likewise, the resistance of the printing fluid may be more easily detected by applying an AC signal of sufficient frequency to reduce the capacitive component of the total impedance to a negligible level.

Figure 5:
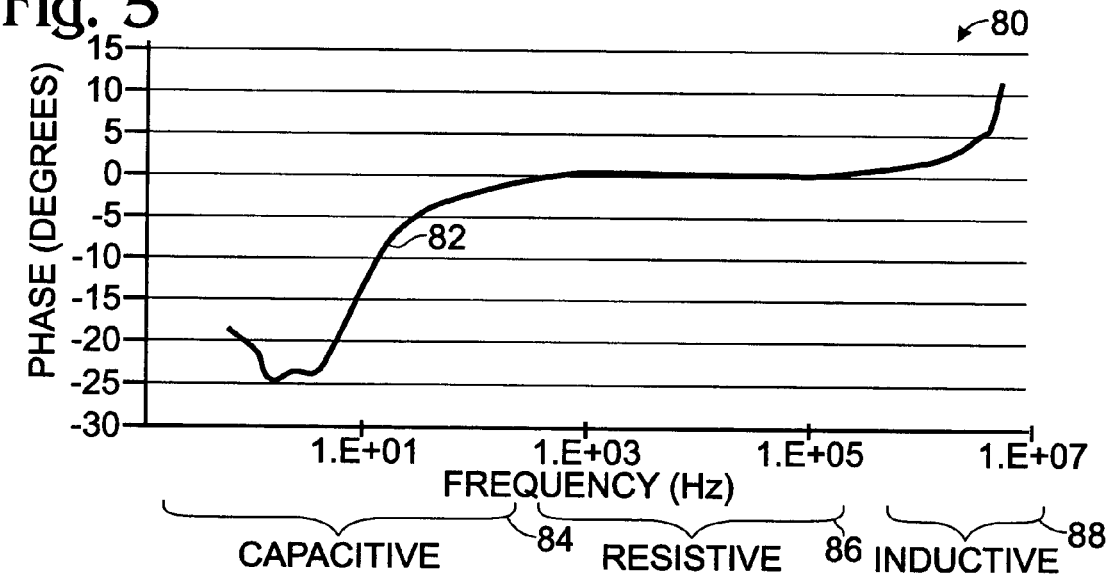
FIG. 5 is a graph showing a measured phase shift between $e_{in}$ and $e_{out}$ of the embodiments of FIGS. 2 and 3 as a function of signal frequency.

FIG. 5 shows, generally at 80, a graph depicting the observed phase shift of a signal in an exemplary printing fluid detector as a function of the log of the frequency of the signal. The data represented in graph 80 was taken from a printing fluid detector full of fluid. Line 82 is drawn through a plurality of data points (not shown) taken over a range of frequencies from approximately 1 Hz to approximately 1 MHz. The phase shift shows a first region 84 between approximately 1 Hz and approximately 1 kHz in which the phase shift varies significantly as a function of the frequency of the supply signal.

Figure 6:
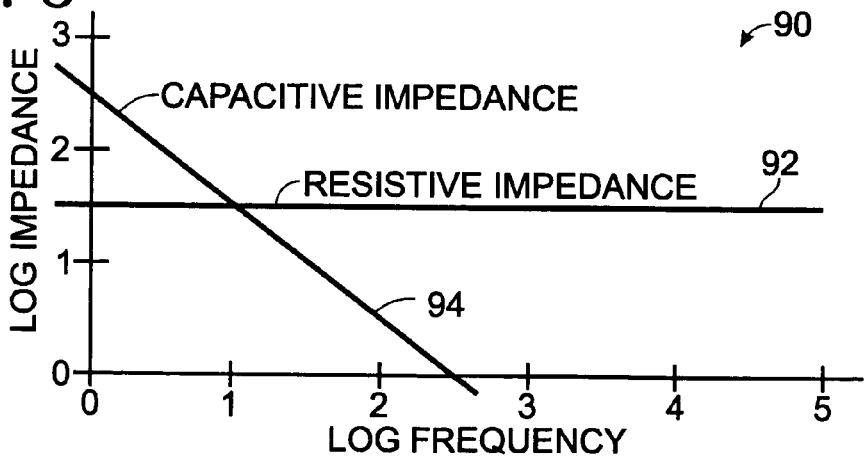
FIG. 6 is a log-log graph showing the relative contributions of capacitance and resistance to the total impedance of the embodiments of FIGS. 2 and 3 as a function of signal frequency.

Referring briefly to FIG. 6, which shows a graph 90 illustrating the frequency dependence of the resistive component of the total impedance of the electrodes and printing fluid at 92 and the capacitive portion of the total impedance at 94, it can be seen that the capacitive component dominates the total impedance at lower frequencies, while the resistive component dominates the total impedance at higher frequencies. Thus, the phase shift of the detected signal compared to the supply signal is expected to be greatest in this region.

Referring again to FIG. 5, the phase shift is seen to be essentially zero in a second, middle region 86 of graph 80, between approximately 1 kHz and 100 kHz. In this region, the capacitive and inductive portions of the impedance are negligible, while the resistive portion is dominant. Finally, the phase shift increases in a third, high-frequency region 88 of graph 80, above approximately 100 kHz. This phase shift is due to inductive effects. Thus, the capacitance of the electrodes as a function of the printing fluid between the electrodes may be measured most sensitively in the capacitive frequency range 84, between approximately 1 Hz and 1 kHz, while the resistance of the printing fluid may be measured most sensitively in resistive frequency region 86, between approximately 1 kHz and 100 kHz.

A capacitance measurement may be made by measuring the difference in phase shift between the signal at $e_{in}$ (of FIG. 2 or 4) and the signal at $e_{out}$. The measured phase shift may be compared to a look-up table containing a plurality of predetermined phase shift values correlated with specific printing fluid types, printing fluid levels, or the presence/absence of printing fluid to determine a desired printing fluid characteristic. Likewise, a resistance measurement may be made by measuring the voltage drop at $e_{out}$ relative to ground (or other suitable reference) combined with measuring the current flowing through the circuit. A resistor (not shown) may be used in parallel with the fluidic resistance to help in the calculation and/or measurement of the resistance. The measured resistance value may then be compared to a look-up table containing a plurality of predetermined resistance values correlated with specific printing fluid types, levels, or the presence/absence of printing fluid to determine the desired printing fluid characteristic.

The determination of printing fluid resistance and/or capacitance values via printing fluid detector 30 has been found to be a quick and reliable method of determining printing fluid types and out-of-fluid conditions. The impedance measurements have been found to be sensitive to changes in fluid types and/or the presence/absence of fluid in contact with the electrodes. Additionally, the impedance measurements have been found to allow the resistance of printing fluid to be distinguished from residual printing fluid froth of a wide range of densities and concentrations of froth that may be left in the printing fluid reservoir after the printing fluid has been emptied.

One difficulty that may be encountered in using capacitance/phase shift and/or resistance measurements to determine an out-of-fluid condition is that, for some printing fluids, the resistance and capacitance (and therefore, the phase shift) measurements of the fluid and residual froth may be dependent to various degrees upon the temperature of the printing fluid in the printing fluid reservoir. Ordinarily, the differences in the capacitance/resistance of the printing fluid and electrodes as compared to air is sufficiently different that any minor variations in the capacitance/resistance of the fluid as a function of temperature may not effect an out-of-fluid determination. However, in some situations, the residual froth left over inside of a printing fluid reservoir after the printing fluid reservoir is substantially emptied of printing fluid may have a resistance similar to the resistance of the printing fluid.

Figure 7:
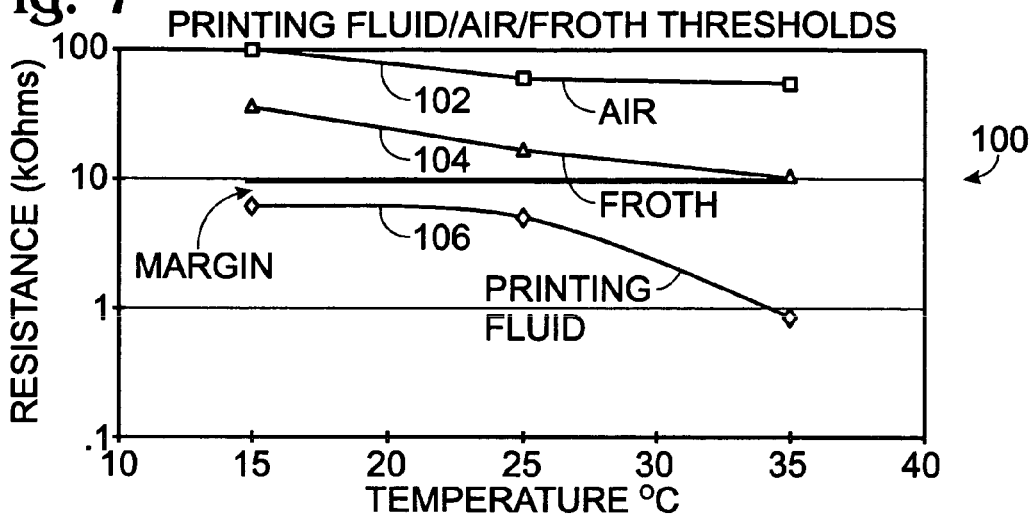
FIG. 7 is a graph showing a temperature dependence of resistance measurements for air, froth and printing fluid.

The resistances of air, froth and printing fluid in an exemplary printing fluid detector 30 are shown at 102, 104 and 106, respectively, in graph 100 of FIG. 7. It can be seen that the margin between the resistance of froth at 35 degrees Celsius and the resistance of the printing fluid at 15 degrees Celsius is fairly narrow, and thus may be difficult for printing fluid detector 30 to distinguish.

To compensate, the following temperature calibration may be performed periodically to ensure that detector circuitry 44 is able to determine that a correct froth threshold is used for the actual temperature. First, the resistances of the printing fluid and froth are experimentally determined over a range of temperatures, and the determined values are recorded in a look-up table stored in memory 46. Next, a series of resistance measurements are taken, and the standard deviation of the measured values is determined. It has been found that a series of resistance measurements taken where froth is between the electrodes has a much higher standard deviation (on the order of 100:1) than a series of resistance measurements taken from a conduit containing printing fluid, which consistently exhibits very low statistical variances or deviations. Thus, if the standard deviation (or other suitable mathematical indication of variability) of the series of resistance measurements is above a preselected threshold, then the printing fluid reservoir is determined to contain froth, and no temperature recalibration is performed. On the other hand, if the standard deviation of the series of resistance measurements is below the preselected threshold, then the printing fluid reservoir is determined to contain printing fluid, and the temperature correlated with the measured printing fluid resistance is located in the look-up table. Finally, the froth resistance corresponding to the determined temperature is set as a new out-of-fluid threshold resistance value.

Besides the standard deviation, any other suitable statistical deviation or measurement of variance may be used to determine whether foam or printing fluid is between the electrodes. Examples include, but are not limited to, a population variance, a mean deviation, and a statistical dispersion. Likewise, any suitable deviation level may be selected as the predetermined threshold between a determination of printing fluid and a determination of froth. Where the statistical deviation is a standard deviation, an example of a suitable range of threshold standard deviations is between approximately 3% and 10%, and more typically 5%, although standard deviations outside of this range may also be used as threshold values.

Any suitable number of impedance measurements may be used in the determination of the statistical deviation. The number of measurements used may depend upon the frequency at which the measurements are taken. For example, where measurements are taken every millisecond, one hundred measurements may be taken. With this sampling rate and sampling set size, the measurements are completed within 0.1 second. It will be appreciated that this sampling rate and sampling set size are merely exemplary, and that any other suitable sampling rate and set size may be used.

The resistance value corresponding to froth may be updated at any desired frequency. For example, the value may be updated as infrequently as once an hour, or even less frequently. Likewise, the value may be updated as frequently as once every few seconds. However, the value is more typically updated every few minutes. Updating the resistance value corresponding to froth every few minutes helps to ensure that the value is updated over a shorter timeframe than typical changes in temperature, yet is not updated so often as to consume printing device resources to a detrimental extent. The measurement of the resistance value corresponding to printing fluid may be facilitated, for example, by actuating a pump to remove froth from the vicinity of the first and second electrodes, where froth is detected initially.

Some printing devices may include a bipolar analog power supply that may be used to produce the alternating supply signal. However, other printing devices may not utilize bipolar voltages, but instead may only have a unipolar voltage source, such as a digital clock signal. The application of such a unipolar voltage source across the electrodes may cause metal ions to plate on the electrodes, which may result in the production of gasses. These gasses may be detrimental to the properties of the printing fluid, and also may cause unwanted pressure to build within printing fluid reservoir 26.

Figure 8:
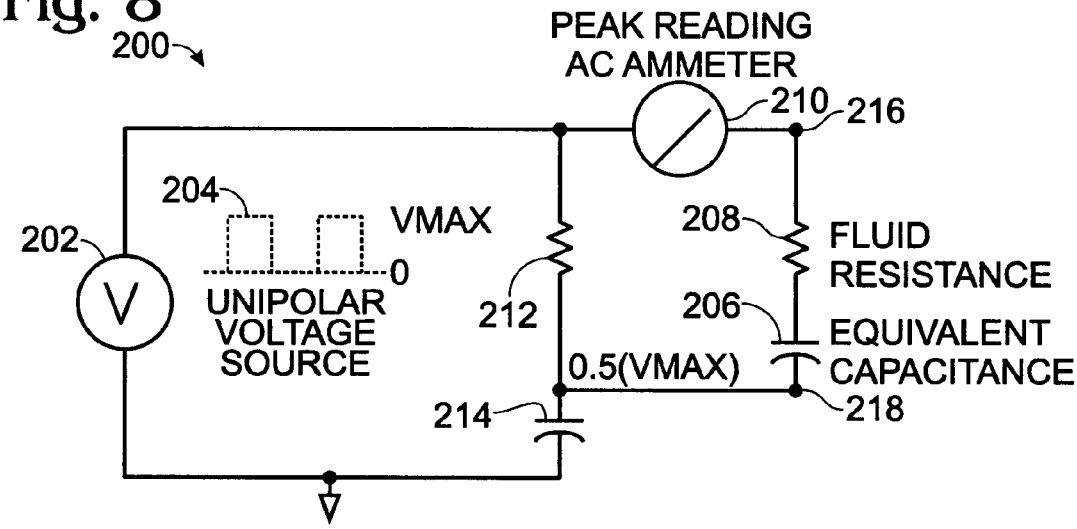
FIG. 8 is a schematic diagram of a first exemplary circuit suitable for producing a bipolar signal from a unipolar voltage source.
Figure 9:
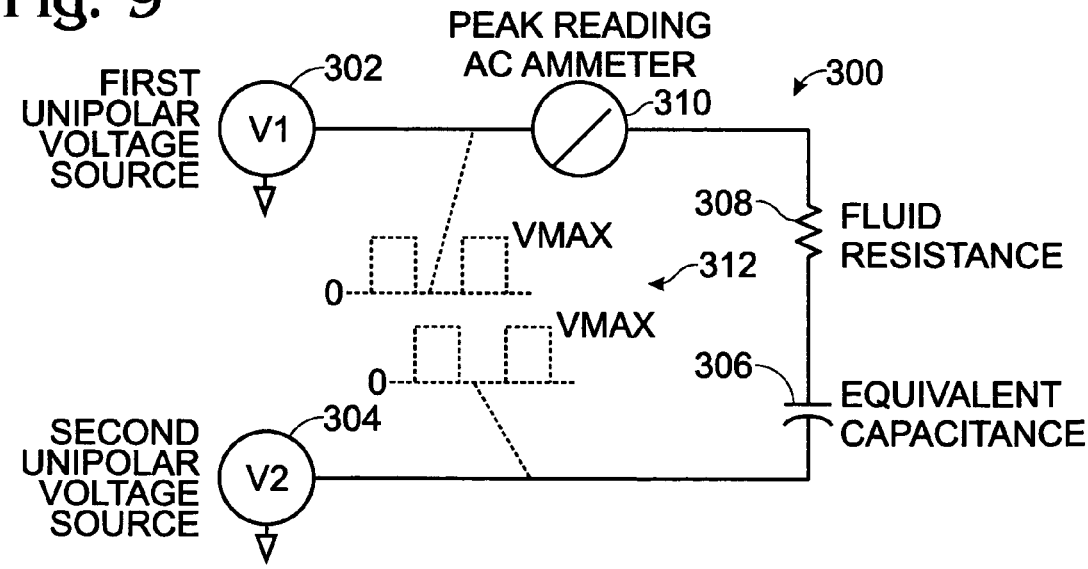
FIG. 9 is a schematic diagram of a second exemplary circuit suitable for producing a bipolar signal from a unipolar voltage source.

To avoid the expense of providing bipolar voltage sources in devices that would not otherwise have them, bipolar conversion circuitry may be provided that creates a bipolar signal from a unipolar source. FIGS. 8 and 9 show two exemplary circuits that may be used to produce a bipolar voltage from one or more unipolar voltage sources.

First, FIG. 8 shows, generally at 200, a bipolar conversion circuit that utilizes a single unipolar alternating power supply 202 to generate a bipolar signal across the first and second electrodes. Power supply 202 is configured to output a digital bi-level unipolar voltage, as shown in diagram 204. Capacitor 206 (labeled "equivalent capacitance"), and resistor 208 (labeled "fluid resistance") together represent the impedance of the first electrode, second electrode and printing fluid. Circuit 200 also includes a peak reading AC ammeter 210 configured to measure the current flow through the fluid and electrodes.

Circuit 200 also includes a resistor 212 in parallel with the fluid impedance, and a capacitor 214 located below the junction at which the currents through resister 212 and the fluid rejoin. The values of resistor 212 and capacitor are 214 selected such that the RC time constant of capacitor 214 and resistor 212 is larger than the frequency of power supply 202, and such that the voltage at capacitor 214 remains at approximately one halt of the maximum output voltage of voltage source 202. Thus, when voltage source 202 Is outputting a positive voltage, the voltage at point 216 is more positive than the voltage at point 218. On the other hand, when power supply 202 is outputting zero volts, capacitor 214 holds point 218 at a more positive voltage than point 216. In this manner, the first and second electrodes alternate as the most positive electrode, helping to avoid plating and gas production problems. It will be appreciated that resistor 212 and capacitor 214 may be configured to hold the voltage at point 218 at any suitable voltage between the maximum and minimum output voltages of power supply 202.

Next, FIG. 9 shows a bipolar conversion circuit 300 that utilizes two unipolar power supplies to create a bipolar signal across the first and second electrodes. Circuit 300 includes a first unipolar power supply 302 connected to one electrode, and a second unipolar voltage source 304 connected to the other electrode. The impedance of the first electrode, second electrode and printing fluid is represented by capacitor 306 (labeled "equivalent capacitance") and resistor 308 (labeled "fluid resistance"). Circuit 300 may include an ammeter 310 to allow the current through the electrodes and printing fluid to be measured, and thus to allow a measured impedance value to be calculated.

The signals supplied by power supplies 302 and 304 are configured to be 180 degrees out of phase, as shown in phase diagram 312. Thus, whenever the signal from power supply 302 is high, the signal from power supply 304 is low and vice versa. This causes the polarities of the two electrodes to be reversed periodically, and thus helps to avoid plating problems and unwanted production of gases in the printing fluid reservoir.

As mentioned above, printing fluid may be transferred from printing fluid reservoir 26 to print head assembly 12 via a suitable pumping mechanism. Where the pumping rate of the pumping mechanism and an initial level of printing fluid in printing fluid reservoir 26 are known, an actual fluid level of printing fluid in reservoir 26 may be calculated. First, when pumping is initiated, the temperature calibration described above for determining the air/froth threshold resistance value may be performed. Next, if printing fluid detector 30 determines that pumping fluid, as opposed to froth, is in conduit 28, the length of time that the pumping mechanism transfers fluid out of printing fluid reservoir 26 may be monitored. Once pumping is completed (or periodically during pumping), the amount of fluid that has been transferred out of printing fluid reservoir 26 may be calculated by multiplying the pumping rate and the pumping time. Finally, the amount of fluid transferred may be subtracted from the initial amount of fluid to determine an amount of printing fluid remaining in printing fluid reservoir 26, which may then be stored in memory 46. This value may then be used as the initial printing fluid amount in a subsequent calculation of printing fluid usage.

This technique of monitoring printing fluid usage may be extended to situations in which froth is being transferred to print head assembly 12 instead of pure printing fluid. Printing fluid froth is typically a mixture of printing fluid and air or other gases. It has been found that the resistance of froth measured by printing fluid detector 30 in the 1 kHz–100 kHz frequency range varies linearly with the fluid content of the froth. Therefore, a look-up table may be constructed by measuring the resistance of froth over a range of air: printing fluid ratios for a selected printing fluid, and then stored in memory 26. Then, as printing fluid or froth is transferred from printing fluid reservoir 26 to print head assembly 12, the amount of printing fluid transferred may be determined first by measuring the resistance of the printing fluid and/or froth in printing fluid detector 30, then comparing the measured resistance to the resistance values stored in the look-up table to determine the fluid:air ratio of the fluid and/or froth in the printing fluid detector, and then calculating how much fluid is transferred by multiplying the pumping time, the pumping rate, and the measured fluid:air ratio.

Although the present disclosure includes specific embodiments, specific embodiments are not to be considered in a limiting sense, because numerous variations are possible. The subject matter of the present disclosure includes all novel and nonobvious combinations and subcombinations of the various elements, features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A printing device, comprising:

a printing fluid reservoir configured to hold a volume of a printing fluid;

a print head assembly configured to transfer the printing fluid to a printing medium;

a conduit fluidically connecting the printing fluid reservoir and the print head assembly; and a printing fluid detector including a first electrode and a second electrode configured to detect an impedance characteristic of the printing fluid, wherein the printing fluid detector is configured to distinguish printing fluid from printing fluid froth by taking an impedance measurement across the first electrode and the second electrode and then comparing the impedance measurement to a froth threshold impedance value that is calibrated to a measured printing fluid temperature.

2. The printing device of claim 1, wherein the printing fluid detector is configured to calibrate the froth threshold impedance value to a measured printing fluid temperature.

3. The printing device of claim 2, wherein the printing fluid detector is configured to recalibrate the froth threshold impedance value by determining a measured printing fluid temperature, and then comparing the measured printing fluid temperature to a plurality of predetermined printing fluid temperatures correlated with specific froth impedance threshold values to determine the froth impedance Threshold value corresponding to the measured printing fluid temperature.

4. The printing device of claim 3, wherein the printing fluid detector is configured to determine the measured printing fluid temperature by taking a plurality of impedance measurements across the first electrode and the second electrode, calculating a measured statistical deviation of the plurality of impedance measurements, and if the measured statistical deviation is less than or equal to a predetermined statistical deviation threshold, then comparing at least one of the impedance measurements to a plurality of predetermined printing fluid impedance values correlated with specific printing fluid temperatures to determine the measured printing fluid temperature.

5. The printing device of claim 4, wherein the statistical deviation is a standard deviation.

6. The printing device of claim 4, wherein the predetermined statistical deviation threshold is a standard deviation of approximately 3–10%.

7. The printing device of claim 4, wherein the printing fluid detector is configured to compare an average of the plurality of impedance measurements to the plurality of predetermined printing fluid impedance values.

8. The printing device of claim 1, wherein the printing fluid detector is configured to recalibrate the froth threshold impedance value on a periodic basis.

9. The printing device of claim 1, further comprising a power supply configured to produce an alternating signal and to apply the alternating signal to the first electrode and the second electrode.

10. The printing device of claim 9, wherein the impedance measurement is a resistance measurement, and wherein the power supply is configured to supply a signal with a frequency of between approximately 1 kHz and 100 kHz.

11. The printing device of claim 9, wherein the alternating signal is unipolar, further comprising a bipolar conversion circuit configured to form a bipolar altemating signal using the unipolar alternating signal, and to provide the bipolar alternating signal to the first electrode and the second electrode.

12. The printing device of claim 11, wherein the power supply is a first power supply and is connected to the first electrode, and wherein the bipolar conversion circuit includes a second power supply connected to the second electrode and configured to output a unipolar alternating signal to the second electrode.

13. The printing device of claim 12, wherein the unipolar alternating signal output by the first power supply is approximately 180 degrees out of phase with the unipolar altemating signal output by the second power supply.

14. The printing device of claim 11, wherein the bipolar conversion circuit includes a capacitor disposed between ground and the second electrode, and wherein the capacitor is configured to be charged by the power supply and to maintain the second electrode at a potential between ground and a maximum output voltage of the power supply.

15. The printing device of claim 14, wherein the bipolar conversion circuit includes a resistor in series with the capacitor, and wherein a resistance of the resistor is selected in combination with the capacitor to give an RC time constant larger than a period of the altermating signal.

16. The printing device of claim 14, wherein the capacitor is configured to hold the second electrode at a potential approximately one half of the maximum output voltage of the power supply.

17. The printing device of claim 1, wherein the electrodes are configured to be in direct contact with the printing fluid.

18. The printing device of claim 1, wherein the electrodes are disposed at least partially within the conduit.

19. The printing device of claim 1, wherein the electrodes are disposed at least partially within the printing fluid reservoir.

20. The printing device of claim 1, wherein the printing device is a printer.

21. A printing device, comprising:

a printing fluid reservoir configured to hold a volume of a printing fluid;

a print head assembly configured to transfer the printing fluid to a printing medium;

a conduit fluidically connecting the printing fluid reservoir to the print head assembly; and a printing fluid detector having a first electrode and a second electrode configured to be in contact with the printing fluid, wherein the printing fluid detector is configured to take a plurality of impedance measurements across the first electrode and the second electrode, to compute a calculated statistical deviation of the plurality of impedance measurements, and to compare the calculated statistical deviation to a predetermined statistical deviation threshold to determine whether the conduit contains printing fluid froth.

22. The printing device of claim 21, wherein the calculated statistical deviation and the predetermined statistical deviation are standard deviations.

23. The printing device of claim 22, wherein the predetermined statistical deviation threshold has a value of approximately 3–10%.

24. The printing device of claim 21, further comprising a power supply configured to output an alternating signal and to apply the alternating signal across the electrodes.

25. The printing device of claim 24, wherein the alternating signal has a frequency of between approximately 1 kHz and 100 kHz.

26. The printing device of claim 24, wherein the alternating signal is unipolar, further comprising a bipolar conversion circuit configured to form a bipolar alternating signal using the unipolar alternating signal, and to provide the bipolar alternating signal to the first electrode and the second electrode.

27. The printing device of claim 26, wherein the power supply is a first power supply and is connected to the first electrode, and wherein the bipolar conversion circuit includes a second power supply connected to the second electrode and configured to output a unipolar alternating signal to the second electrode.

28. The printing device of claim 27, wherein the unipolar alternating signal output by the first power supply is approximately 180 degrees out of phase with the unipolar alternating signal output by the second power supply.

29. The printing device of claim 26, wherein the bipolar conversion circuit includes a capacitor disposed between ground and the second electrode, and wherein the capacitor is configured to be charged by the power supply and to hold the second electrode at a potential between a minimum output voltage and a maximum output voltage of the power supply.

30. The printing device of claim 29, wherein the bipolar conversion circuit includes a resistor in series with the capacitor, and wherein a resistance of the resistor is selected in combination with the capacitor to give an RC time constant larger than the period of the alternating signal.

31. The printing device of claim 29, wherein the capacitor is configured to hold the second electrode at a potential approximately one half of the maximum output voltage of the power supply.

32. The printing device of claim 21, wherein the printing fluid detector includes detector circuitry having a processor operatively linked to a memory containing a set of instructions executable by the processor to compare at least one of the plurality of impedance measurements to a plurality of predetermined impedance values stored in the memory and correlated with specific printing fluid temperatures to determine a measured printing fluid temperature.

33. The printing device of claim 32, wherein the set of instructions are executable by the processor to determine the measured printing fluid temperature if the measured statistical deviation is lower than the predetermined statistical deviation threshold.

34. The printing device of claim 32, wherein the set of instructions are executable by the processor to compare, the measured printing fluid temperature to a plurality of predetermined printing fluid temperatures that are correlated with specific printing fluid froth threshold impedances to determine a calibrated froth threshold impedance.

35. The printing device of claim 34, wherein the set of instructions are executable by the processor to periodically redetermine the measured printing fluid temperature and the calibrated froth threshold impedance value.

36. The printing device of claim 34, wherein the set of instructions are executable by the processor to take a new printing fluid impedance measurement after determining the calibrated froth threshold impedance value, and to compare the new printing fluid impedance measurement to the calibrated froth threshold impedance value to determine if the conduit contains printing fluid froth.

37. The printing device of claim 32, wherein the instructions are executable by the processor to compare an average of the plurality of impedance measurements to the plurality of predetermined impedance values.

38. In a printing device having a printing fluid detector that includes a first electrode and a second electrode configured to be in contact with the printing fluid, a method of determining the presence of printing fluid froth between the first electrode and the second electrode, the method comprising:

taking a plurality of impedance measurements across the first electrode and the second electrode;

determining a measured statistical deviation of the plurality of impedance measurements; and comparing the measured statistical deviation of the plurality of impedance measurements to a predetermined statistical deviation threshold.

39. The method of claim 38, wherein the measured statistical deviation and the predetermined statistical deviation threshold are standard deviations.

40. The method of claim 39, wherein the predetermined statistical deviation threshold is a standard deviation of approximately 3–10%.

41. The method of claim 38, wherein printing fluid froth is determined to exist between the first electrode and the second electrode if the measured statistical deviation is above the predetermined statistical deviation threshold.

42. The method of claim 38, wherein printing fluid is determined to exist between the first electrode and the second electrode if the measured statistical deviation is below the predetermined statistical deviation threshold.

43. The method of claim 42, further comprising determining a calibrated froth threshold impedance value if the measured statistical deviation is below the predetermined statistical deviation.

44. The method of claim 43, wherein determining a calibrated froth threshold impedance value includes comparing at least one of the impedance measurements to a plurality of predetermined impedance values correlated to specific printing fluid temperatures to determine a measured printing fluid temperature.

45. The method of claim 44, wherein an average of the plurality of impedance measurements is compared to the plurality of predetermined impedance values.

46. The method of claim 44, further comprising determining a calibrated froth threshold impedance value by comparing the measured printing fluid temperature to a plurality of predetermined printing fluid temperatures correlated to specific froth impedance threshold values to determine the specific froth impedance threshold value corresponding to the measured printing fluid temperature.

47. The method of claim 46, further comprising taking a new impedance measurement after determining the calibrated froth threshold impedance value, comparing the new impedance measurement to the calibrated froth threshold impedance value, and determining that printing fluid froth exists between the first electrode and second electrode if the new impedance measurement exceeds the calibrated froth threshold impedance value.

48. The method of claim 48, wherein the calibrated printing fluid froth threshold value is updated periodically.

49. The method of claim 38, further comprising applying an altermating signal to the first electrode and the second electrode.

50. The method of claim 49, wherein the alternating signal has a frequency of between approximately 1 kHz and 100 kHz.

51. The method of claim 49, wherein the alternating signal is unipolar, further comprising forming a bipolar alternating signal using the unipolar alternating signal, and applying the bipolar alternating signal to the first electrode and the second electrode.

52. The method of claim 51, wherein the unipolar alternating signal is a first signal, and wherein forming a bipolar alternating signal includes applying the first signal to the first electrode and applying a second bipolar alternating signal that is approximately 180 degrees out of phase with the first bipolar alternating signal to the second electrode.

53. The method of claim 51, wherein forming a bipolar alternating signal includes applying the unipolar alternating signal to the first electrode while maintaining the second electrode at a potential between a minimum voltage and a maximum voltage of the unipolar alternating signal.

54. The method of claim 53, wherein the second electrode is maintained at a potential between a minimum voltage and a maximum voltage by a capacitor in electrical communication with the second electrode.

55. The method of claim 38, wherein the printing device is a printer.

56. The method of claim 38, wherein the electrodes are disposed at least partially within a conduit configured to transport printing fluid from a printing fluid reservoir to a print head assembly.

57. In a printing device having a printing fluid detector configured to determine a presence of printing fluid froth in a printing fluid delivery system, wherein the printing fluid detector includes a first electrode and a second electrode configured to be in contact with the printing fluid, a method of distinguishing printing fluid from printing fluid froth, the method comprising:

taking an impedance measurement across the first electrode and the second electrode;

comparing the impedance measurement to a froth threshold impedance value that is calibrated to a measured printing fluid temperature; and if the impedance measurement has a preselected relationship to the froth threshold impedance value, then determining that at least some froth exists between the first electrode and the second electrode.

58. The method of claim 57, wherein at least some froth is determined to exist between the first electrode and the second electrode if the impedance measurement exceeds the froth threshold impedance value.

59. The method of claim 57, further comprising calibrating the froth threshold impedance value before taking the impedance measurement across the first electrode and the second electrode.

60. The method of claim 59, wherein calibrating the froth threshold impedance value includes taking a plurality of impedance measurements across the first electrode and the second electrode, determining a measured standard deviation of the plurality of impedance measurements, and if the measured standard deviation is less than a preselected standard deviation threshold, then comparing an average of the plurality of impedance measurements to a plurality of predetermined impedance measurements correlated with specific printing fluid temperatures to determine the specific printing fluid temperature corresponding to the average of the impedance measurements.

61. The method of claim 59, wherein calibrating the froth threshold impedance value includes comparing the measured printing fluid temperature with a plurality of predetermined printing fluid temperatures correlated with specific froth threshold impedance value to determine the froth threshold impedance value corresponding to the measured printing fluid temperature.

62. A printing device, comprising:

a printing fluid reservoir configured to hold a volume of printing fluid;

a print head assembly configured to transfer the printing fluid onto a printing medium;

a conduit configured to transport the printing fluid from the printing fluid reservoir to the print head assembly; and a printing fluid detector configured to detect a presence or absence of printing fluid in at least one of the printing fluid reservoir, the conduit and the print head assembly, wherein the printing fluid detector includes a first electrode, a second electrode, and a power supply configured to output a unipolar alternating signal, and wherein the printing fluid detector also includes a bipolar conversion circuit configured to form a bipolar alternating signal using the unipolar alternating signal and to provide the bipolar alternating signal to the first electrode and the second electrode.

63. The printing device of claim 62, wherein the impedance measurement is a resistance measurement, and wherein the power supply is configured to supply a signal with a frequency of between approximately 1 kHz and 100 kHz.

64. The printing device of claim 62, wherein the power supply is a first power supply and is connected to the first electrode, and wherein the bipolar conversion circuit includes a second power supply connected to the second electrode and configured to output a unlpolar alternating signal to the second electrode.

65. The printing device of claim 64, wherein the unipolar alternating signal output by the first power supply is approximately 180 degrees out of phase with the unipolar alternating signal output by the second power supply.

66. The printing device of claim 62, wherein the bipolar conversion circuit includes a capacitor disposed between ground and the second electrode, and wherein the capacitor is configured to be charged by the power supply and to hold the second electrode at a potential between ground and a maximum output voltage of the power supply.

67. The printing device of claim 66, wherein the bipolar conversion circuit includes a resistor in series with the capacitor, and wherein a resistance of the resistor is selected in combination with the capacitor to give an RC time constant larger than the period of the alternating signal.

68. The printing device of claim 66, wherein the capacitor is configured to hold the second electrode at a potential approximately one half of the maximum output voltage of the power supply.

* * * * *

UNITED STATES PATENT AND TRADEMARK OFFICE

CERTIFICATE OF CORRECTION

PATENT NO. : 7,029,082 B2
APPLICATION NO. : 10/613797
DATED : April 18, 2006
INVENTOR(S) : Isaac Farr et al.

It is certified that error appears in the above-identified patent and that said Letters Patent is hereby corrected as shown below:

In column 3, line 62, delete “too” and insert -- to --, therefor.

In column 3, line 65, after “supply” insert -- side --.

In column 10, line 2, delete “halt” and insert -- half --, therefor.

In column 11, line 57, in Claim 3, delete “Threshold” and insert -- threshold --, therefor.

In column 12, line 25, in Claim 11, delete “altemating” and insert -- alternating --, therefor.

In column 12, line 37, in Claim 13, delete “altemating” and insert -- alternating --, therefor.

In column 12, line 48, in Claim 15, delete “altermating” and insert -- alternating --, therefor.

In column 13, line 67, in Claim 34, after “compare” delete “,”.

Signed and Sealed this

Twenty-eighth Day of April, 2009

John Doll

JOHN DOLL
*Acting Director of the United States Patent and Trademark Office*